United States Patent [19]

Musitano et al.

[11] 4,133,479

[45] Jan. 9, 1979

[54] EXHAUST GAS MUFFLER FOR AN INTERNAL COMBUSTION ENGINE

[76] Inventors: Charles M. Musitano, c/o K.M.R. Industries, Inc., 4 Valley View Dr., Goddard, Kans. 67052; Robert B. King, c/o Mrs. Burns King, N. "C" St., Wellington, Kans. 67152

[21] Appl. No.: 826,529

[22] Filed: Aug. 22, 1977 (Under 37 CFR 1.47)

[51] Int. Cl.[2] ..... B60H 1/02

[52] U.S. Cl. ..... 237/12.3 A; 181/264; 181/268

[58] Field of Search ..... 237/12.3 A; 181/264, 181/268, 279, 280, 281, 265

[56] References Cited

U.S. PATENT DOCUMENTS

| | | | |
|---|---|---|---|
| 1,446,725 | 2/1923 | Shamberg | 237/12.3 A |
| 2,009,343 | 7/1935 | Peik | 181/265 X |
| 2,618,355 | 11/1952 | Hedrick | 181/264 |
| 2,774,439 | 12/1956 | Chesser | 181/264 |

FOREIGN PATENT DOCUMENTS

| | | | |
|---|---|---|---|
| 475689 | 7/1951 | Canada | 181/268 |
| 721548 | 11/1965 | Canada | 181/268 |

*Primary Examiner*—Roy D. Frazier
*Assistant Examiner*—Peter A. Aschenbrenner
*Attorney, Agent, or Firm*—Edwin H. Crabtree

[57] ABSTRACT

An exhaust gas muffler for an internal combustion engine. The muffler designed to increase back pressure to the engine within acceptable manufacturer limits and increase the frequency of the sound of the exhaust gas so that the acoustic energy is more easily attenuated when exhausted into the atmosphere.

7 Claims, 7 Drawing Figures

EXHAUST GAS MUFFLER FOR AN INTERNAL COMBUSTION ENGINE

BACKGROUND OF THE INVENTION

This invention relates generally to a muffler for exhaust gas and more particularly, but not by way of limitation, to a muffler used with an aviation engine to reduce exhaust gas noise.

Heretofore, there have been various structural designs of exhaust mufflers for automotive and aircraft engines. These mufflers are primarily designed to reduce back pressure to the cylinders of the engine. By reducing back pressure, the horsepower of the engine is increased and the engine life is improved.

With the recent advent of federal laws requiring the reduction of sound and air pollution from combustion engines, it has been found that the older muffler designs in some instances are not sufficient to meet the new government standards.

A typical prior art muffler used with aviation engines is disclosed in U.S. Pat. No. 3,043,098 to Hannon, wherein an exhaust heater-muffler combination is used in combination with a four cylinder or six cylinder aircraft engine. This type of muffler is designed to reduce back pressure to the engine. The Hannon muffler divides an inner core can into separate chambers by a splitter plate. The exhaust gasses are received through exhaust tubes at both ends of the separate chambers. By preventing the exhaust gas received in the separate chambers from opposing each other, the back pressure to the cylinders of the engine is reduced. This type muffler does not provide a sound attenuator for increasing the back pressure within acceptable limits so that the sound frequency of the exhaust gas may be increased and the acoustic energy is more easily attenuated when exhausted to the atmosphere.

SUMMARY OF THE INVENTION

The subject invention greatly reduces exhaust gas noise. The noise of the exhaust gas is reduced by increasing the frequency of the gas sound to a high level.

The noise attenuation is accomplished by raising the back pressure to the engine within acceptable limits forcing the exhaust gas to flow from one chamber to another thereby "working" the gas. The "working" of the gas is accomplished by first expanding the exhaust gas in one chamber thereby reducing the pressure and heat by expansion and then compressing the gas through apertures in a divider plate which increases the velocity of the gas and raises the frequency. As the gas flows through the apertures in the divider plate, the gas is again expanded into a separate discharge chamber giving up additional heat and energy. The gas is then discharged through the discharge tail pipe again slightly compressing the gas and further extracting energy from the gas prior to exhausting the gas into the atmosphere.

Also, the "working" of the exhaust gas is further accomplished by introducing exhaust intake pipes at opposite ends of the chambers so that the exhaust gas of one cylinder forces the exhaust gas from a previously fired cylinder through the apertures in the divider plate. By "working" the exhaust gas by expanding and compressing the gas twice inside the muffler prior to exhausting to the atmosphere, the heat and pressure of the gas is reduced while the frequency is increased.

The exhaust muffler for an internal combustion engine includes an enclosed cylindrical core can having a core can chamber therein. A sound attenuator is disposed inside the can chamber and includes a first divider plate, an apertured second divider plate, and an apertured third divider plate. The plates are attached to each other in the center of the can chamber and extend radially outward and attach to the interior wall of the can. The plates divide the can chamber into three separate chambers. The three separate chambers are a first intake chamber, a second intake chamber, and a discharge chamber. The first intake chamber and second intake chamber receive exhaust gas at both ends of the chambers from separate intake pipes attached to the cylinders of the engine. The exhaust gas is received in the first intake and second intake chamber where it is forced through the apertured plates into the discharge chamber. From the discharge chamber, the exhaust gas is received in a discharge tail pipe where it is exhausted into the atmosphere.

The advantages and objects of the invention will become evident from the following detailed description when read in conjunction with the accompanying drawings which illustrate the preferred embodiments of the invention.

DETAILED DESCRIPTION OF THE DRAWINGS

Figure 1:
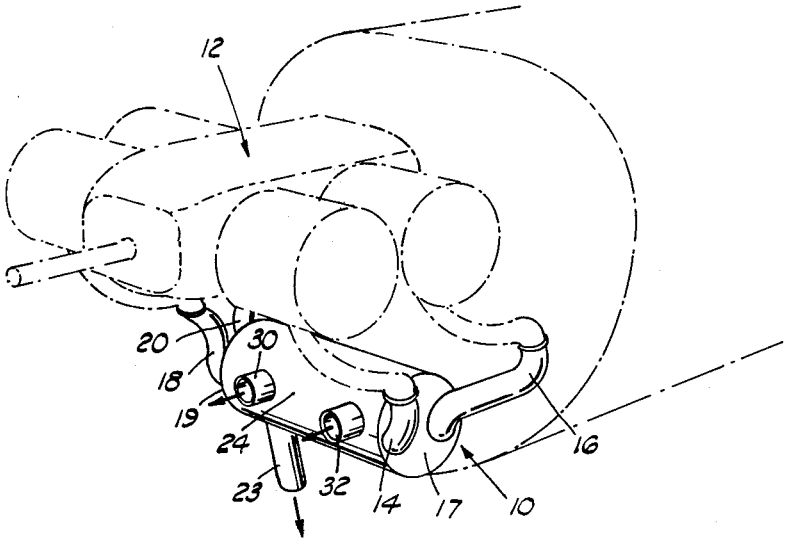
FIG. 1 is a perspective view of the muffler mounted below a four cylinder aviation engine.

In FIG. 1, the exhaust gas muffler is designated by general reference numeral 10. The muffler 10 is disposed below a typical four cylinder aviation engine 12 shown in dotted lines. While the four cylinder engine 12 is discussed, it should be appreciated that various types of internal combustion engines having different numbers of cylinders could be used equally well with the subject invention to realize significant sound attenuation in muffling the noise of the exhaust gasses from the particular engine.

The muffler 10 includes a first intake pipe 14, a second intake pipe 16, and a third intake pipe 18, and a fourth intake pipe 20. The pipes 14, 16, 18, and 20 are communicably connected to the four cylinders of the engine 12 for receiving the exhaust gasses therefrom and communicating the gasses into a core can 22 shown in cross section in FIG. 5. The core can 22 forms an enclosed core can chamber 21 for receiving the exhaust gasses therein. The pipes 14 and 16 are attached to a first end plate 17. The pipes 18 and 20 are attached to a second end plate 19. The plates 17 and 19 enclose the ends of the can 22. A discharge tail pipe 23 is communicably connected to the bottom of the core can 22.

Figure 2:
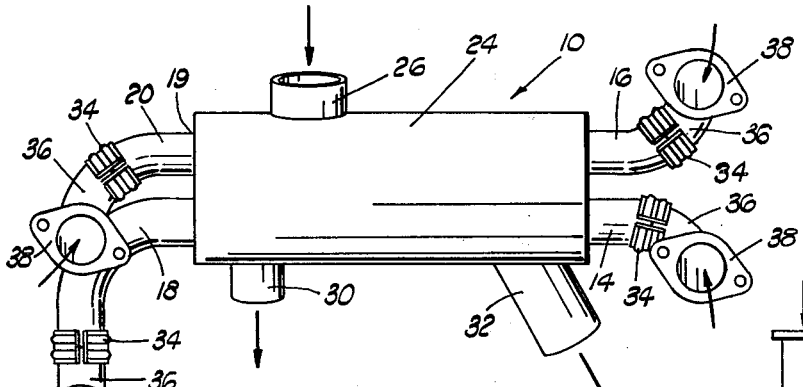
FIG. 2 is a top view of the muffler.
Figure 5:
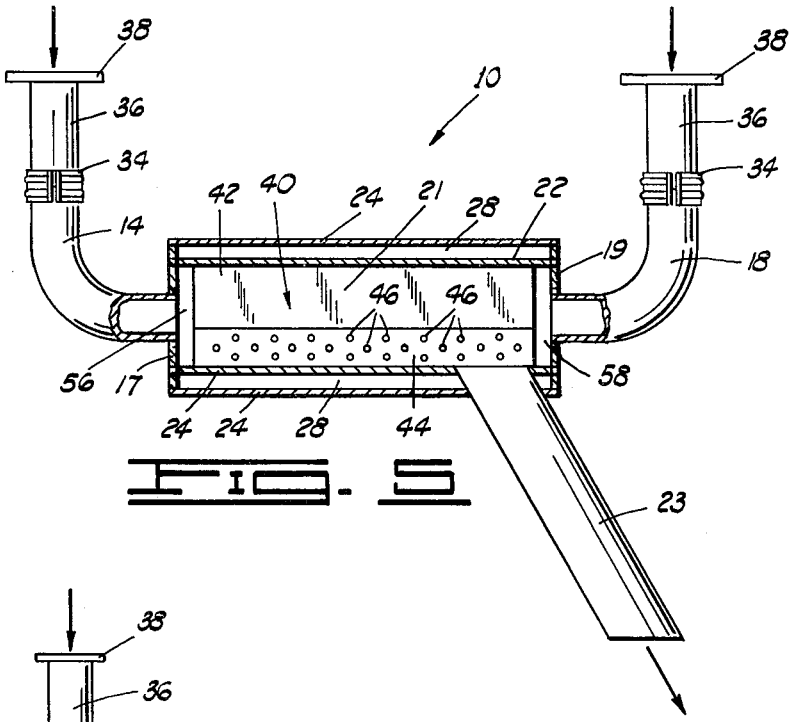
FIG. 5 is a side sectional view of the muffler taken along lines 5—5 shown in FIG. 4.

The muffler 10 includes a heater shroud 24 which surrounds the core can 22 in a spaced relationship for receiving fresh air through a fresh air inlet pipe 26 shown in FIG. 2 which circulates the fresh air into an air warming chamber 28 shown in FIG. 5. The fresh air is heated and exhausted from the air warming chamber 28 through a carburetor air heat outlet pipe 30 and a cabin air heat outlet pipe 32. The air from the carburetor air heat outlet pipe 30 provides the carburetor of the engine with preheated air. The cabin air heater outlet pipe 32 provides the cabin of the aircraft with heated air. The shroud 24 is attached to the outer circumference of the end plates 17 and 19.

In FIG. 2, a top view of the muffler 10 is shown. In this view, the fresh air inlet pipe 26 is shown disposed on one side of the shroud 24 with the carburetor air heat outlet pipe 30 and cabin air heat outlet pipe 32 on the opposite side of the shroud 24. Attached to the intake pipes 14, 16, 18, and 20 are pipe clamps 34 for securing them to exhaust pipes 36 having flanges 38 used for securing the pipes 36 to the engine 12.

Figure 3:
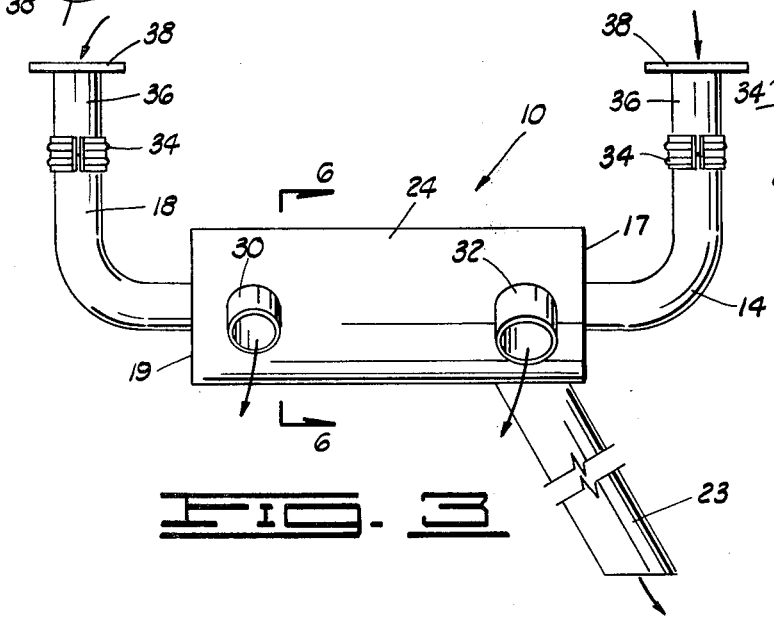
FIG. 3 is a side view of the muffler.

In FIG. 3, a side view of the muffler 10 is shown. In this view, the tail pipe 23 can be seen extending downwardly from the muffler 10.

Figure 4:
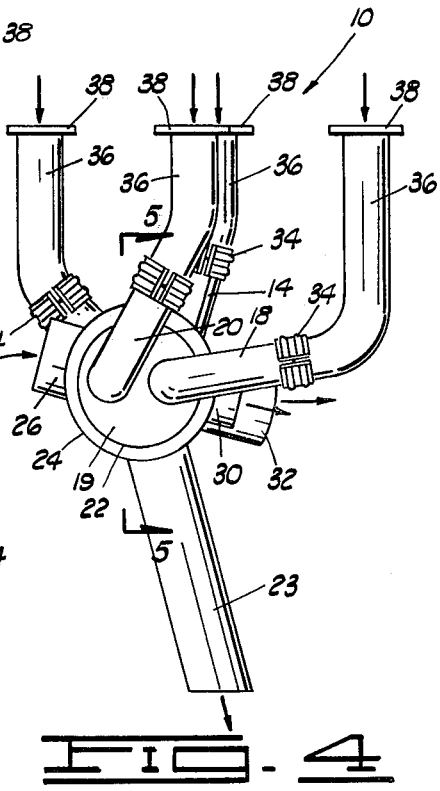
FIG. 4 is an end view of the muffler.

In FIG. 4 an end view of the muffler 10 is illustrated. The muffler 10 can be seen with second end plate 19 attached to the end of the core can 22 and the shroud 24. It should be noted that the ends of the third intake pipe 18 and fourth intake pipe 20 are disposed on opposite sides from the center of the second end plate 19. On the opposite end of the muffler 10, the intake pipes 14 and 18 are disposed on the opposite sides from the center of the first end plate 17.

In FIG. 5, a side sectional view of the muffler 10 is illustrated taken along lines 5—5 shown in FIG. 4. In this view, the internal structure of the muffler 10 can be seen. The air warming chamber 28 can be seen surrounding the core can 22 and between the outer surface of the core can 22 and the inner surface of the shroud 24.

Figure 6:
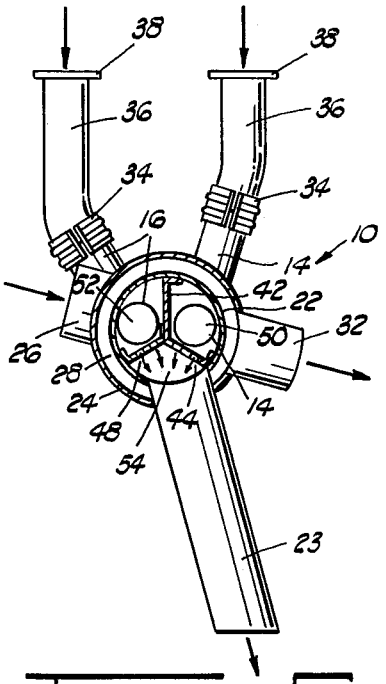
FIG. 6 is an end sectional view of the muffler taken along lines 6—6 shown in FIG. 3.
Figure 7:
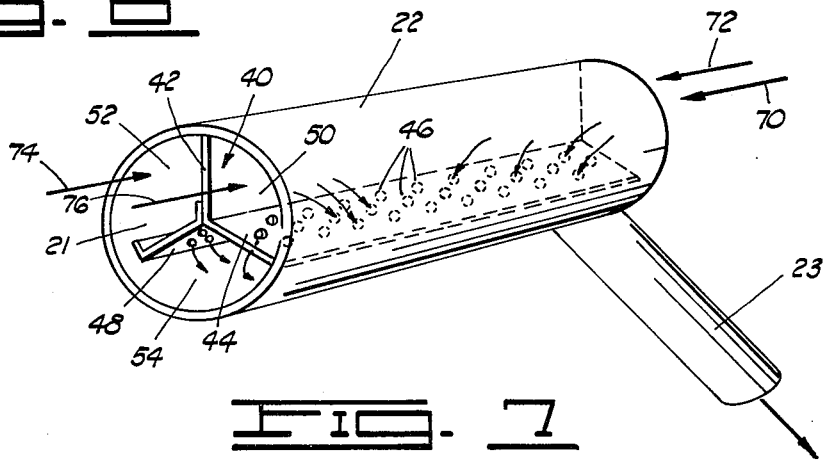
FIG. 7 is a perspective view of the core can and sound attenuator.

Inside the core can 22 is a sound attenuator 40 for suppressing the noise of the exhaust gasses. The attenuator 40 includes an elongated angular shaped first divider plate 42, an elongated angular shaped second divider plate 44 having a plurality of apertures 46 therein in a spaced relationship along the length of the plate 44 and a third divider plate 48 also having a plurality of apertures 46 in a spaced relationship along the length of the plate 48. The third divider plate 48 is seen in FIGS. 6 and 7. The plates 42, 44, and 48 are attached to each other in the center of a core can chamber 21 inside the core can 22. The plates 42, 44, and 48 may be made separately or as shown in FIG. 7, the plates 42 and 44 are integrally attached and formed from a single plate. The plates 42, 44, and 48 extend outwardly and radially where they are attached to the interior wall of the core can 22. The plates 42, 44, and 48 divide the core can chamber 21 into three separate chambers. The chambers are a first intake chamber 50, a second intake chamber 52, and a discharge chamber 54. The chambers are seen more clearly in FIG. 7.

The first intake pipe 14 is communicably connected to the first intake chamber 50 at the first end plate 17 while the third intake pipe 18 is connected also to the first intake chamber 50 at the opposite second end plate 19. Likewise, the second intake pipe 16 is communicably connected to the second intake chamber 52 at the first end plate 17, while the fourth intake pipe 20 is connected to the second intake chamber 52 at the opposite second end plate 19.

The plates 42, 44, and 48 are parallel and extend along the length of the can 22. The ends of the plates are spaced apart apprximately 0.1 to 0.15 inches from the end plates 17 and 19 to provide a controlled amount of leakage of exhaust gas between the chambers 50, 52, and 54. These spaces are designated by numbers 56 and 58.

In FIG. 6, an end section view of the muffler 10 taken along lines 6—6 shown in FIG. 3 is illustrated. In this view, an end view of the first intake pipe 14 centered at one end of the first intake chamber 50 and the second intake pipe 16 centered at one end of the second intake chamber 52 is shown. Gasses flow from the chambers 50 and 52 through the apertures 46 in the second divider plate 44 and third divider plate 48 into the discharge chamber 54 where the gasses are discharged out the tail pipe 23.

In FIG. 7, the core can 22 and sound attenuator 40 are illustrated with the shroud 24 removed. In this illustration, the intake pipes 14, 16, 18 and 20 are represented by arrows 70, 72, 74, and 76.

In operation, the exhaust gas is received from the first intake pipe 14 then discharged in one end of the first intake chamber 50 where the gas expands along the length of the chamber 50 thereby reducing the heat and pressure of the gas. The gas is compressed as it is forced through the apertures 46 in the second divider plate 44. As the gas passes through the apertures 46 into the discharge chamber 54, the gas again is expanded thereby again reducing the pressure and heat of the gas while increasing the frequency of the gas. While this is happening, the exhaust gas received from the second intake pipe 16 is received in the second intake chamber 52 and it also expands along the length of the second intake chamber 52 and is compressed through the apertures 46 in the third divider plate 48 and received in the discharge chamber 54. As the exhaust gas in the first intake chamber 50 is exiting through the second divider plate 44, the gas from the third intake pipe 18 is received in the opposite end of the first intake chamber 50. By introducing the gasses at the opposite ends of the intake chambers 50 and 52, the gasses tend to work against each other thereby forcing the gasses through the apertures 46 in the plates 44 and 48. Likewise, the exhaust gas from the fourth intake pipe 20 is received in the second intake chamber 52 and again assists in forcing the exhaust gas received from the second intake pipe 16 through the apertures 46. By a proper spaced relationship of the apertures 46 in the second divider plate 44 and third divider plate 48 and controlling the size of the apertures 46, and the size of the chambers 50, 52, and 54 the back pressure to the engine 12 is increased within acceptable manufacturer limits. The exhaust gasses are properly worked by first expanding the gasses in the first and second intake chambers 50 and 52. The gasses are compressed through the apertures 46 in the second and third divider plates 44 and 48 increasing the velocity of the gasses and raising the frequency. The gasses are then expanded in the discharge chamber 54 thereby reducing again the pressure and heat due to expansion. Likewise, the gasses are again compressed by discharging the gasses out the tail pipe 23 and exhausting them into the atmosphere.

It has been found that the amount of noise reduction in the muffler 10 is directly proportional to the number of times the gasses are expanded and compressed in the separate chambers 50, 52, and 54 provided in the core can 22. By controlling the volume of the chambers 50, 52, and 54, the apertures 46 in the divider plates 44 and 48 and the proper working of the exhaust gasses in the chambers, the most predominate frequencies of the exhaust gasses from the internal combustion engine 12 are attenuated. The muffler 10 successfully reduces engine noise to comply with federal regulations as to noise abatement without effecting engine performance.

It should be noted that the muffler 10 is connected with the exhaust pipes 36 of the engine 12 so that during the firing order of the cylinders of the engine 12, the first intake chamber 50 receives exhaust gas at one end than the second intake chamber 52 receives exhaust gas. The opposite end of the first intake chamber 50 then receives exhaust gas and followed by the opposite end of the second intake chamber 52 finally receiving exhaust gas. By alternating from chamber 50 to chamber 52 and from one end to the opposite end of the chambers 50 and 52, a lag time is provided so that the exhaust gas can travel the length of the chambers 50 and 52 and compressed through the aperture 46. By alternating the introduction of the exhaust gas at opposite ends of the chambers 50 and 52, the exiting gas is urged through the apertures 46 by the newly received gas at the opposite end of the chambers 50 and 52.

Changes may be made in the construction and arrangement of the parts or elements of the embodiment as disclosed herein without departing from the spirit or scope of the invention as defined in the following claims.

I claim:

1. An exhaust gas muffler for an internal combustion engine, the muffler comprising:

an enclosed cylindrical core can forming a core can chamber therein, said core can having a first end and a second end;

a sound attenuator disposed inside said core can chamber, said attenuator including;

more than one divider plate extending along the length of said core can and parallel thereto, said plates attached to the interior wall of said can and including a plurality of apertures therein for receiving exhaust gas therethrough, said plates dividing said can chamber into three separate chambers which include a first intake chamber, a second intake chamber, and a discharge chamber;

a plurality of intake pipes attached to said core can and communicably connected to said first and second intake chambers for discharging exhaust gas therein; and a discharge tail pipe attached to said core can and communicably connected to said discharge chamber for receiving the exhaust gas therefrom.

2. An exhaust gas muffler for an internal combustion engine, the muffler comprising:

an enclosed cylindrical core can forming a core can chamber therein, said core can having a first end and a second end;

a sound attenuator disposed inside said core can chamber, said attenuator including;

a first divider plate;

a second divider plate having a plurality of apertures for receiving exhaust gasses therethrough;

a third divider plate having a plurality of apertures for receiving exhaust gasses therethrough;

said plates extending along the length of said core can and parallel thereto, said plates attached to each other in the center of said can chamber and extending radially outward and attached to the interior wall of said can, said plates dividing said can chamber into three seperate chambers which include, a first intake chamber, a second intake chamber, and a discharge chamber, said first divider plate dividing said first intake chamber from said second intake chamber, said second divider plate dividing said second intake chamber from said discharge chamber, said third divider plate dividing said first intake chamber from said discharge chamber;

a plurality of intake pipes attached to said core can and communicably connected to said first and second intake chambers for discharging exhaust gas therein; and a discharge tail pipe attached to said core can and communicably connected to said discharge chamber for receiving the exhaust gas therefrom.

3. The muffler as described in claim 2, wherein a space is provided between the first end and second end of said core can and the ends of said plates for providing a controlled amount of leakage at both ends of the core can chamber and between the first intake chamber, second intake chamber, and discharge chamber.

4. The muffler as described in claim 2, wherein said intake pipes include:

a first intake pipe attached to the first end of said core can and communicably connected to said first intake chamber;

a second intake pipe attached to the first end of said core can and communicably connected to said second intake chamber;

a third intake pipe attached to the second end of said core can and communicably connected to said first intake chamber; and a fourth intake pipe attached to the second end of said core can and communicably connected to said second intake chamber.

5. The muffler as described in claim 4, wherein said first, second, third, and fourth intake pipes are communicably connected to the cylinders of the internal combustion engine to receive exhaust gas from the cylinders of the engine in a firing order to correspond with their numerical designation.

6. The muffler as described in claim 2, further including a heater shroud surrounding said core can in a spaced relationship thereto and attached to the first and second ends of said can, said shroud forming an air warming chamber between the interior of said shroud and the exterior of said core can, said shroud having a fresh air inlet pipe attached thereto and communicating with said air warming chamber for circulating fresh air thereto, and a cabin air heat outlet pipe and a carburetor air heat outlet pipe attached to said shroud and communicating with said air warming chamber for discharging heated air from said air warming chamber to an air cabin and a carburetor of the engine.

7. An exhaust gas muffler for an internal combustion engine, the muffler comprising:

an enclosed cylindrical core can forming a core can chamber therein, said core can having a first end and a second end;

a heater shroud surrounding said core can in a spaced relationship thereto and attached to the first and second ends of said can, said shroud forming an air warming chamber between the interior of said shroud and the exterior of said core can;

a sound attenuator disposed inside said core can chamber, said attenuator including:

a first divider plate;

a second divider plate having a plurality of apertures in a spaced relationship along its length for receiving exhaust gasses therethrough;

a third divider plate having a plurality of apertures in a spaced relationship along its length, the apertures of said second divider plate and said third divider plate dimensioned in a sized relationship for receiving a controlled amount of exhaust gas therethrough;

said plates extending along the length of said core can and parallel thereto, said plates attached to each other in the center of said can chamber and extending radially outward and attached to the interior wall of said can, said plates dividing said can chamber into three seperate chambers which include a first intake chamber, a second intake chamber, and a discharge chamber, said first divider plate dividing said first intake chamber from sad second intake chamber, said second divider plate dividing said second intake chamber from said discharge chamber, said third divider plate dividing said first intake chamber from said discharge chamber;

a first intake pipe attached to the fist end of said core can and communicably connected to said first intake chamber;

a second intake pipe attached to the first end of said core chamber and communicably connected to said second intake chamber;

a third intake pipe attached to the second end of said core can and communicably connected to said first intake chamber;

a fourth intake pipe attached to the second end of said core can and communicably connected to said second intake chamber; and a discharge tail pipe attached to said core can and communicably connected to said discharge chamber for receiving the exhaust gas therefrom.

* * * * *